US005402188A

United States Patent [19]

Wayne

[11] Patent Number: 5,402,188

[45] Date of Patent: Mar. 28, 1995

[54] ATHLETIC PACING GOGGLES

[76] Inventor: Thomas R. Wayne, 11530 E. Michigan, Galesburg, Mich. 49053

[21] Appl. No.: 931,842

[22] Filed: Aug. 17, 1992

[51] Int. Cl.[6] ..... G02C 11/04; G04B 47/00; F21L 1/00

[52] U.S. Cl. ..... 351/43; 362/105; 368/10; 2/426

[58] Field of Search ..... 351/158, 43; 2/422, 2/426, 428, 431, 440, 442; 362/29, 31, 105, 106, 103; 368/10

[56] References Cited

U.S. PATENT DOCUMENTS

| | | | |
|---|---|---|---|
| 2,535,809 | 12/1950 | Niendorff . | |
| 2,888,703 | 6/1959 | Karwowska . | |
| 3,038,120 | 6/1962 | Bernstein et al. . | |
| 3,119,610 | 1/1964 | Clinton | 472/85 |
| 3,492,582 | 1/1970 | Heywood | 340/323 R |
| 3,540,344 | 11/1970 | Veech | 84/484 |
| 3,712,714 | 1/1973 | Uyeda et al. | 359/857 |
| 3,882,480 | 5/1975 | Greber | 340/321 |
| 3,914,031 | 10/1975 | Sisler | 359/629 |
| 4,283,127 | 8/1981 | Rosenwinkel et al. | 351/158 |
| 4,283,798 | 8/1981 | Kuehn | 2/426 |
| 4,309,599 | 1/1982 | Myers | 377/5 |
| 4,571,680 | 2/1986 | Wu | 364/410 |
| 4,776,045 | 10/1988 | Mysliwiec et al. | 2/426 |
| 4,796,987 | 1/1989 | Linden | 351/158 |
| 4,867,442 | 9/1989 | Matthews | 482/8 |
| 5,033,818 | 7/1991 | Barr | 359/630 |
| 5,040,790 | 8/1991 | Anthes et al. | 273/35 R |
| 5,162,828 | 11/1992 | Furness et al. | 351/158 |

FOREIGN PATENT DOCUMENTS

| | | |
|---|---|---|
| 56-6214 | 1/1981 | Japan . |
| 58-113914 | 7/1983 | Japan . |
| 2126369 | 3/1984 | United Kingdom . |

*Primary Examiner*—Loha Ben
*Assistant Examiner*—John Juba, Jr.
*Attorney, Agent, or Firm*—Joseph K. Andonian

[57] ABSTRACT

Pacing goggles are provided which include a pacing device that conveys a rhythmic or periodic visual signal to the swimmer. The intermittent signal provides a metronome-like reference for use in pacing the swimmer's strokes. The frequency of the intermittent signal can be adjusted to correspond with the swimmer's preferred pace. In a preferred embodiment, the pacing device is contained in a waterproof hydrodynamic housing that is mounted to the corner contour of the eye shield of swim goggles.

10 Claims, 1 Drawing Sheet

ATHLETIC PACING GOGGLES

BACKGROUND OF THE INVENTION

The present invention relates to sport goggles. More particularly, the present invention relates to swimming goggles which optically display a rhythmic signal for pacing a swimmer's strokes.

It is widely recognized that athletes perform better when they are properly paced. Proper pacing conserves energy and maximizes performance. A variety of means for aiding an athlete in pacing have been developed. Such means include audible, visual and tactile signalling devices.

One method for pacing a swimmer is to have an individual human being convey information to the swimmer. This technique suffers in that it requires an individual for each swimmer and the commands are often difficult to hear. In particular, this method is not suited to the boisterous atmosphere of a swim meet. In addition, the swimmer is unable to devote complete concentration to swimming.

U.S. Pat. No. 3,492,582, issued Jan. 27, 1970 to Heywood, discloses a head band and ear piece which generates a rhythmic audible signal. The frequency of this signal is controlled by a second person via a transmitting unit. The metronome-like signal can be used to pace a swimmer's strokes. This invention suffers in that the head band is bulky and creates unnecessary drag which slows the swimmer. Additionally, the audible signal makes it difficult for a swimmer to hear other sounds.

U.S. Pat. No. 2,535,809, issued Dec. 26, 1950 to Niendorff, discloses a signalling device that attaches to the wrist and provides a rhythmic vibratory pulse. This pulse may be used to pace a swimmer's stroke. Tactile signals are not particularly useful in swimming because they can become confused with the flow of water against the swimmer. Further, this device is attached to the swimmer's body and therefore creates drag which slows the swimmer.

Goggles for visually displaying information to the wearer have been developed. One such invention is disclosed in U.S. Pat. No. 4,776,045, issued Oct. 11, 1988 to Mysliwiec, wherein swimming goggles incorporate an elapsed time clock and a visual display in the corner contour of an eye shield. The clock is actuated upon contact with water, and the display shows the elapsed time. This unit provides little, if any, assistance in pacing individual strokes. The display provides elapsed time and requires significant mental conversion to be used as a pacing metronome. Further, the swimmer is required to focus upon the display in order to read the output. This causes the swimmer to sacrifice complete concentration on swimming.

U.K. Patent No. GB 2 126 369 A, issued Mar. 21, 1984 to Pincus, discloses a timing device that is attachable to goggles. This device displays elapsed time on a minute display. Pincus suffers from the same disadvantages as Mysliwiec. In addition, the timing device has a large profile and creates unnecessary drag.

SUMMARY OF THE INVENTION

The aforementioned problems are overcome by the present invention wherein a swimming goggle attachment is provided that includes a means for visually conveying a rhythmic signal for use in pacing a swimmer's strokes. More particularly, the present invention is mountable on or incorporated within swimming goggles and includes an LED (light emitting diode) driven by a potentiometer-controlled astable multivibrator circuit. A periodic visual signal is therefore provided to act as a visual metronome upon which the eye cannot focus.

The LED and astable multivibrator circuitry are housed in a waterproof hydrodynamic housing which may be mounted to the corner contour of an eye shield of conventional swimming goggles. The LED extends out from the interior of this housing and through the side wall of the eye shield and is seated within. The LED is positioned within the peripheral vision of the swimmer, but not within the swimmer's usual line of sight.

The LED progresses through a repetitive on/off cycle thereby creating a visual metronome. The frequency of this on/off cycle is adjustable by means of a potentiometer. The potentiometer is located within the housing and has an adjustment knob accessible from the exterior of the housing. The potentiometer is adjusted to provide the desired pacing frequency, and the swimmer may pace his or her strokes to coincide with either the on or the off period of the on/off cycle. This will ensure consistent pacing and maximize the swimmer's efficiency.

These and other objects, advantages, and features of the present invention will be more fully understood and appreciated by reference to the detailed description of the preferred embodiment and the drawings.

DETAILED DESCRIPTION OF THE PREFERRED EMBODIMENT

Figure 1:
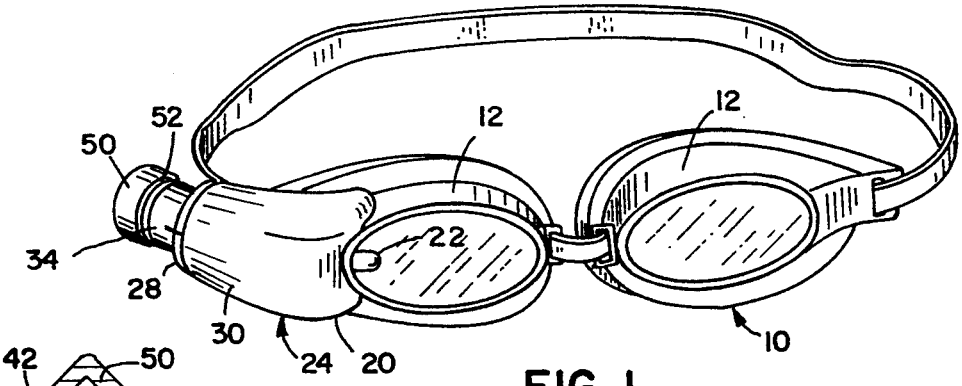
FIG. 1 is a perspective view of the swim goggles pacing unit of the present invention.

A preferred embodiment of the present invention is illustrated in FIG. 1 and generally includes swimming goggles 10 and a pacing device 20 which visually conveys a pacing signal to the swimmer. The pacing device 20 includes an LED 22 and a potentiometer-controlled astable multivibrator circuit (see FIG. 4). The LED 22 repetitively passes through an on/off cycle thereby conveying a rhythmically blinking signal for use as a visual metronome. The frequency of the on/off cycle is adjustable by means of a potentiometer (pot) 44 included in the circuitry.

The pacing device 20 is housed in a hydrodynamic waterproof housing 24 that mounts to or is part of the eye shield 12 of the swimming goggles 10. This housing 24 is shaped to follow the contour of the eye shield 12 and the swimmer's head. The housing 24 includes goggle end 26, pot end 28, front wall 30 and back wall 32.

Figure 2:
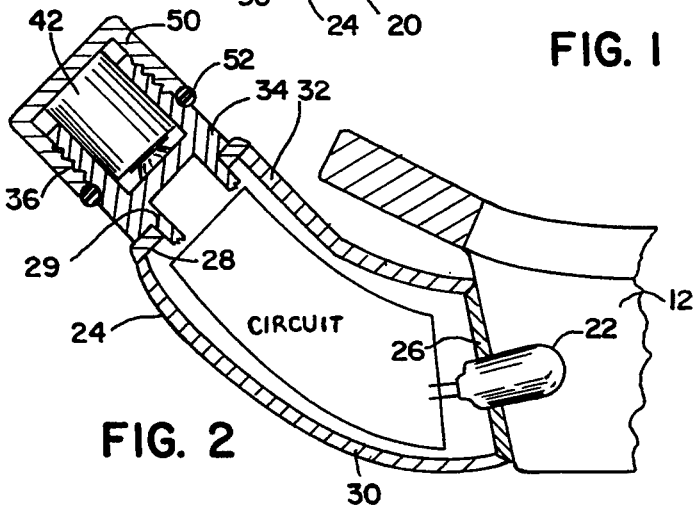
FIG. 2 is a fragmentary sectional view of the eye shield and attached pacing device.

The goggle-end wall 26 of the housing is generally concave and is contoured to approximate the side wall of the eye shield 12. The front wall 30 of the housing 24 is generally convex and is contoured to wrap around and provide side walls for the housing. The front wall 30 abuts with the laterally opposed edges of the back wall 32. The back wall 32 is generally concave and is contoured to approximate the shape of the swimmer's head (see FIG. 2).

The goggle-end wall 26 of the housing 24 and the exterior side wall of the eye shield 12 adjacent thereto each includes a substantially centered circular opening. These openings are of sufficient diameter to allow the LED 22 to extend concentrically through them. The LED 22 is seated within the housing 24 and extends out through the opening in the goggle-end wall 26 of the housing 24. When mounted to the eye shield 12, the goggle-end wall 26 of the housing 24 and the side wall of the eye shield 12 closely abut, and the LED 22 further extends through the opening in the side wall of the eye shield 12 (see FIG. 2). In this position, the LED 22 is within the peripheral vision of the swimmer, but is not within the swimmer's usual line of sight. Alternatively the side wall of the eye shield 12 may be formed without any opening for passage of the LED 22 therethrough. Instead, the LED 22 may be generally flat in shape and positioned against the exterior of the side wall of the eye shield 12. In this construction, an opening in the side wall (and attendant water leakage problems) is avoided and the LED 22 is still within the peripheral vision of the swimmer. A water-proof adhesive (not shown) is used to secure the pacing device 20 to the goggles 10. Alternatively, the housing 24 could be formed integral with the goggles 10.

Figure 3:
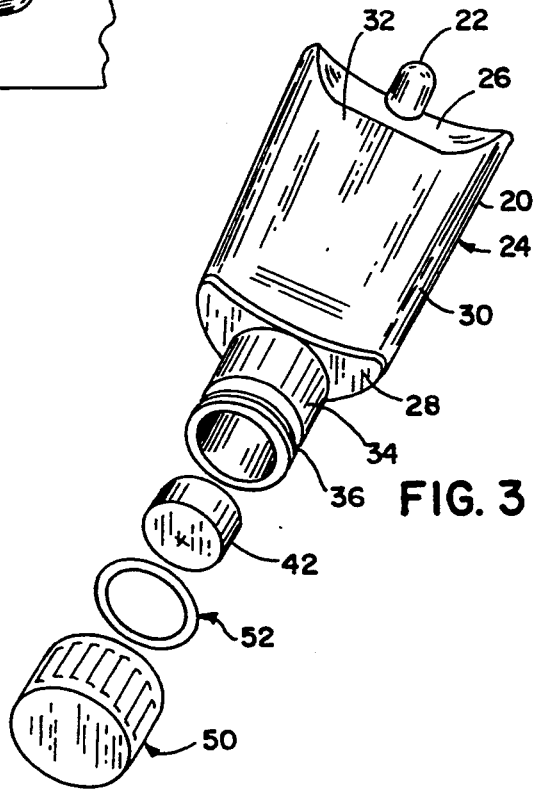
FIG. 3 is an exploded perspective view of the pacing device.

The pot-end wall 28 of the housing 24 is substantially flat and includes a circular opening 29 substantially centered on the pot-end 28. A hollow shaft 34 extends from a potentiometer 44 (see FIG. 4) seated within the housing 24 and concentrically through the circular opening in the pot-end wall 28, the diameter of the hollow shaft 34 being slightly smaller than the diameter of the circular opening in the pot-end wall 28. A battery 42 for powering the circuitry is seated within the hollow shaft 34. The exterior of the hollow shaft is threaded. An internally threaded cap 50 and a ring seal 52 are disposed on the threaded end of the hollow shaft 36 and provide a waterproof enclosure for the battery 42 (see FIG. 3).

The shaft 34 is an actuating means for the potentiometer 44 and has a 270 degree range of rotation. The force required to screw or unscrew the cap 50 is substantially greater than the force necessary to actuate the potentiometer 44. Therefore, if properly operated, the cap 50 can be used as a knob for rotating the shaft 34 without breaching the integrity of the battery's waterproof housing.

The pacing device 20 is deactivated when the shaft 34 is positioned in its counterclockwise-most position. By rotating the shaft 34 in a clockwise direction the astable multivibrator circuit is activated and current is intermittently applied to the LED 22. The LED 22 is rhythmically activated in response to the current thereby conveying a metronome-like visual signal. The frequency of the LED's on/off cycle is controlled by the position of the shaft 34, and is increased as the shaft 34 is rotated in a clockwise direction. By actuating the shaft 34, the swimmer may adjust the pacing device to convey a pacing signal of the preferred frequency. The presently anticipated range of adjustment is 30 to 120 cycles per minute (cpm).

Figure 4:
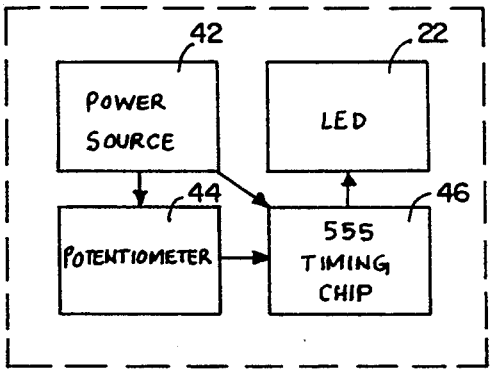
FIG. 4 is a schematic diagram of the pacing device timing circuit.

As shown in FIG. 4, the invention is driven by a potentiometer-controlled astable multivibrator circuit. These circuits are well known to those having skill in the art. In a preferred embodiment, the astable multivibrator circuit includes a 555 integrated circuit 46. The output of the 555 integrated circuit 46 oscillates between a high (approximately source voltage level) and low state (approximately ground level). As is well known, the frequency of this oscillation is a function of the resistance and capacitance along various points within the circuit. The potentiometer 44 provides a means to vary this resistance and thereby vary the frequency of the oscillation.

The invention has been described in conjunction with swim goggles, but is equally applicable to any activity in which a pacing or other periodic signal is desirable. Such activities might include running, bicycling, or aerobics.

The above description is that of a preferred embodiment of the invention. Various changes and alterations can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. Athletic pacing goggles for use by an athlete comprising:

goggles having a pair of eye shields each having a peripheral portion;

a pacing device which is attached to the peripheral portion of one of said eye shields and includes a means positioned on the side wall of said one eye shield for displaying a periodic signal wherein said signal is visible to said athlete in the peripheral portion of said athlete's vision in said one eye shield and is not a signal on which the eve can focus and wherein said pacing device includes adjustment means enabling the athlete to adjust the frequency of said periodic signal.

2. Athletic pacing goggles as defined in claim 1 wherein said adjustment means includes a potentiometer.

3. Athletic pacing goggles as defined in claim 1 wherein said pacing device further includes an astable multivibrator circuit.

4. Athletic pacing goggles as defined in claim 1 wherein said pacing device further includes a waterproof hydrodynamic housing, and further wherein said one of said eyeshields and said housing have cooperating contours.

5. Pacing swimming goggles comprising:

swimming goggles having two eye shields;

a pacing device including a housing attached to a peripheral portion of one of said eye shields, said pacing device further including optical signaling means for emitting an optical signal, said optical signaling means being positioned at the side wall of said one eye shield, said pacing device further including a timer means for emitting a periodic signal to said optical signaling means, said optical signaling means being responsive to said periodic signal to display a periodic optical signal on which the eye cannot focus, whereby said pacing device provides a visual metronome within the peripheral vision of one wearing said goggles, and adjustment means enabling the swimmer to vary the frequency of said periodic optical signal.

6. Pacing swimming goggles as defined in claim 5 wherein said adjustment means includes a potentiometer.

7. Pacing swimming goggles as defined in claim 6 wherein said adjustment means further includes an actuating shaft connected to said potentiometer and extending from said pacing device housing.

8. Pacing swimming goggles as defined in claim 5 wherein said pacing device housing is waterproof and hydrodynamic and further wherein said housing is shaped to substantially match the contour of said one eye shield.

9. Pacing swimming goggles as defined in claim 5 wherein said optical signaling means extends through said peripheral portion of said one eyeshield.

10. The pacing swimming goggles of claim 5 wherein said optical signal is a blinking light.

* * * * *